US008079939B1

(12) United States Patent
Wang

(10) Patent No.: US 8,079,939 B1
(45) Date of Patent: Dec. 20, 2011

(54) ELECTRIC TREADMILL WITH A FOLDING MECHANISM BY USE OF A SWIVEL PIECE

(76) Inventor: Leao Wang, Taiping (TW)

( * ) Notice: Subject to any disclaimer, the term of this patent is extended or adjusted under 35 U.S.C. 154(b) by 0 days.

(21) Appl. No.: 12/815,409

(22) Filed: Jun. 15, 2010

(51) Int. Cl.
*A63B 22/02* (2006.01)

(52) U.S. Cl. ..... 482/54

(58) Field of Classification Search ..... 482/51, 482/52, 54

See application file for complete search history.

(56) References Cited

U.S. PATENT DOCUMENTS

| | | | | |
|---|---|---|---|---|
| 6,033,347 | A * | 3/2000 | Dalebout et al. | 482/54 |
| 6,059,695 | A * | 5/2000 | Hung | 482/54 |
| 6,077,200 | A * | 6/2000 | Lin | 482/54 |
| 6,383,120 | B1 * | 5/2002 | Lo | 482/54 |
| 6,475,121 | B2 * | 11/2002 | Wang et al. | 482/54 |
| 6,494,814 | B1 * | 12/2002 | Wang et al. | 482/54 |
| 6,638,200 | B2 * | 10/2003 | Chang | 482/54 |
| 7,166,065 | B2 * | 1/2007 | Chang | 482/54 |
| 7,192,388 | B2 * | 3/2007 | Dalebout et al. | 482/54 |
| 7,540,828 | B2 * | 6/2009 | Watterson et al. | 482/54 |
| 2009/0069159 | A1 * | 3/2009 | Wang | 482/54 |
| 2009/0093347 | A1 * | 4/2009 | Wang | 482/54 |

FOREIGN PATENT DOCUMENTS

| | | | |
|---|---|---|---|
| EP | 1459786 | A1 * | 9/2004 |
| EP | 2127701 | A1 * | 12/2009 |

* cited by examiner

*Primary Examiner* — Stephen Crow

(57) ABSTRACT

An electric treadmill with a folding mechanism by use of a swivel piece includes a handrail frame mounted at both sides of the front end of the base frame. Moreover, an axle is positioned near the middle portion of the bottom of the base frame for pivotally connecting with a swivel piece at both sides thereof, respectively. A pull rod is pivotally interposed between the swivel piece and the handrail frame. Moreover, a rear support frame having ground-touching rollers is pivotally connected to the axle such that the rear support frame is constantly supported by a telescopic support element. When the base frame is folded upward, the rear support frame is pushed forward by an action portion of the telescopic support element. Meanwhile, the ground-touching rollers are always in contact with the ground in a supporting position. In this way, the base frame can be brought in a stable folded-up position.

1 Claim, 5 Drawing Sheets

ELECTRIC TREADMILL WITH A FOLDING MECHANISM BY USE OF A SWIVEL PIECE

BACKGROUND OF THE INVENTION

1. Fields of the Invention

The invention relates to an electric treadmill with a folding mechanism by use of a swivel piece, and more particularly, to a treadmill having a simplified structure for an effective reduction of the manufacturing cost.

2. Description of the Related Art

As shown in FIG. 5, a treadmill with a folding apparatus according to TW 481008 includes at least four joints 12, 13, 14, 15 between a handrail frame 10 and a base frame 11, a front and a rear support frame 16, 17 as well as telescopic support elements for conducting the folding movement. Although the above-mentioned structure may achieve the expected effect, it is obvious that the components of this structure are complicated, thereby causing a difficult assembly and having a high manufacturing cost. Therefore, the conventional structure requires further improvements.

SUMMARY OF THE INVENTION

An object of the invention is to provide an electric treadmill with a folding mechanism by use of a swivel piece wherein the swivel piece is swivelable responsive to the position of the handrail frame relative to the base frame such that the conventional joints are not required for conducting the folding action. In this way, a simplified structure with the effect of reducing the manufacturing cost is achieved.

According to the invention, an electric treadmill with a folding mechanism by use of a swivel piece includes a handrail frame mounted at both sides of the front end of the base frame. Moreover, an axle is positioned near the middle portion of the bottom of the base frame for pivotally connecting with a swivel piece at both sides thereof, respectively. A pull rod is pivotally interposed between the swivel piece and the handrail frame. Moreover, a rear support frame having ground-touching rollers is pivotally connected to the axle such that the rear support frame is constantly supported by a telescopic support element. When the base frame is folded upward, the rear support frame is pushed forward by an action portion of the telescopic support element. Meanwhile, the ground-touching rollers are always in contact with the ground in a supporting position. In this way, the base frame can be brought in a stable folded-up position.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
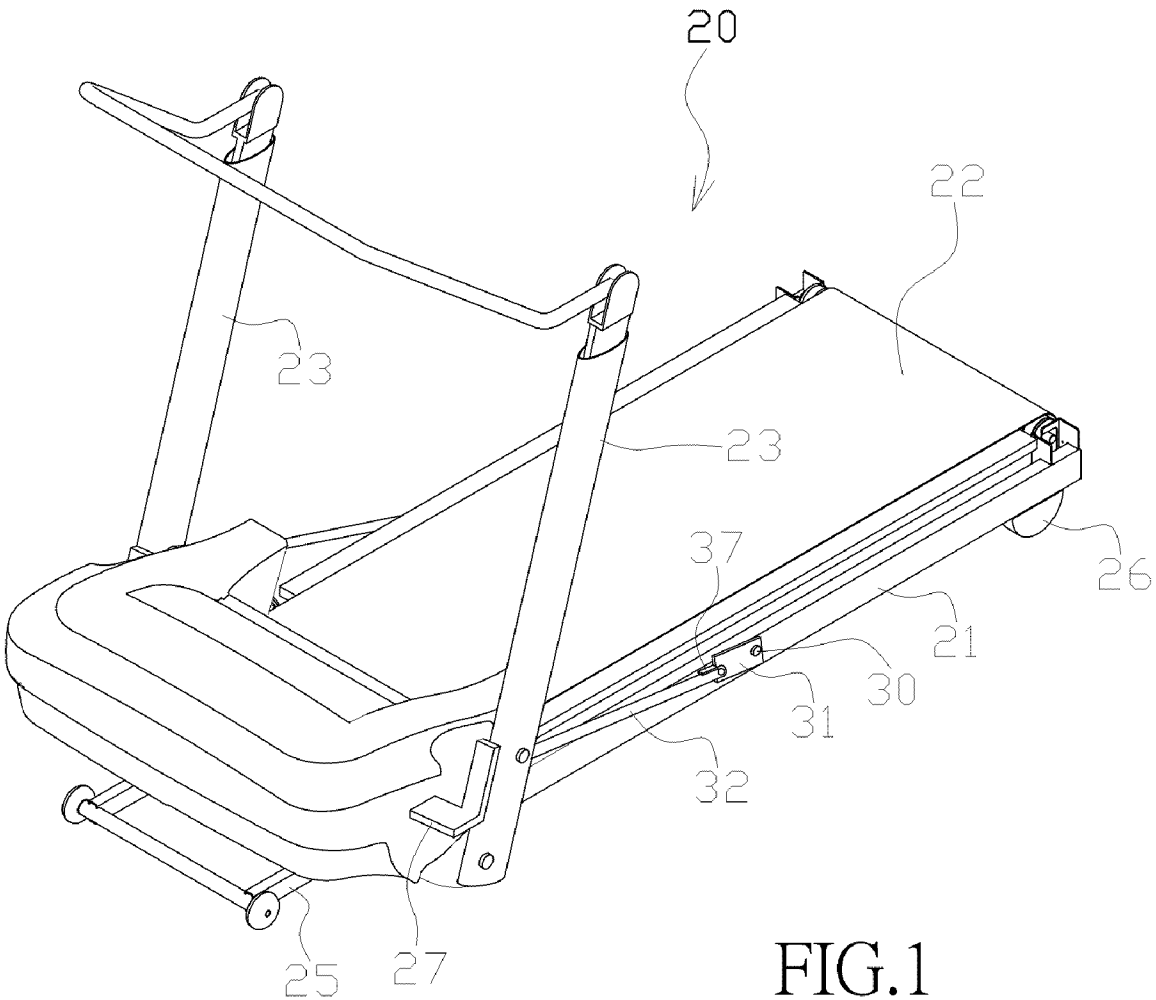
FIG. 1 is a perspective assembly view of the invention.
Figure 2:
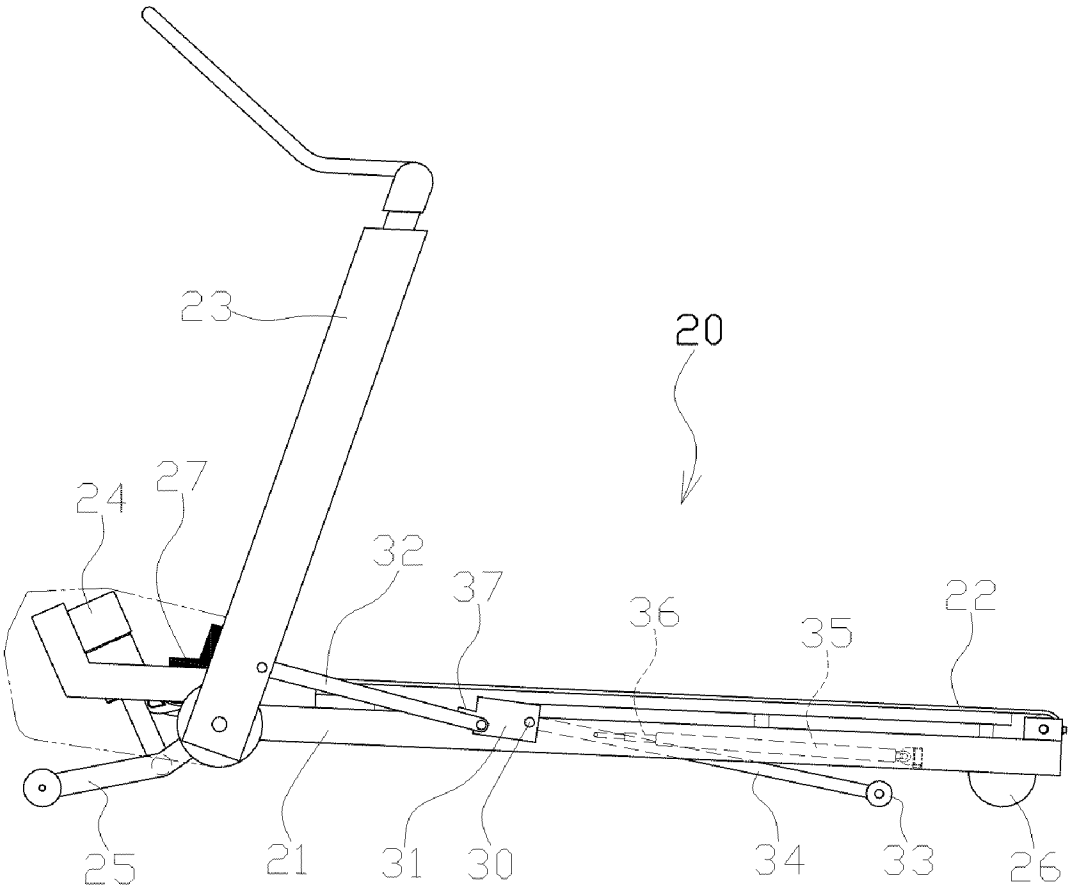
FIG. 2 is a side view of the invention according to FIG. 1.

Referring to FIGS. 1 and 2, a treadmill 20 according to the invention includes a continuous moving belt 22 positioned around a base frame 21 and driven by an electric motor (not shown). A handrail frame 23 is mounted at both sides of the front end of the base frame 21. The bottom of the front end of the base frame 21 is provided with a front support frame 25 driven by a lifting motor 24 for adjusting the supporting angle of the base frame 21 that stands for the exercise slope. Moreover, several ground-touching elements 26 are fitted to the bottom of the rear side of the base frame 21.

Figure 3:
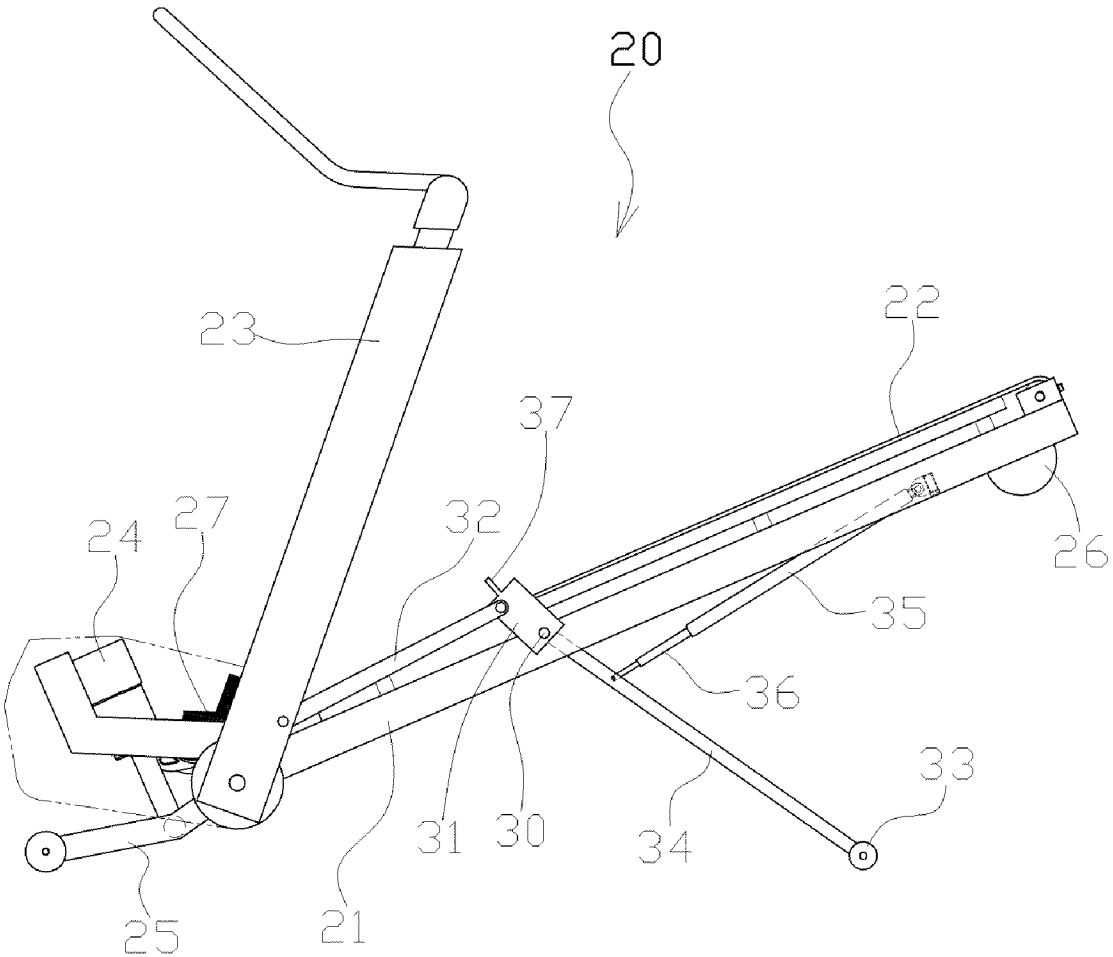
FIG. 3 is a schematic drawing I of the operation of the invention according to FIG. 2.
Figure 4:
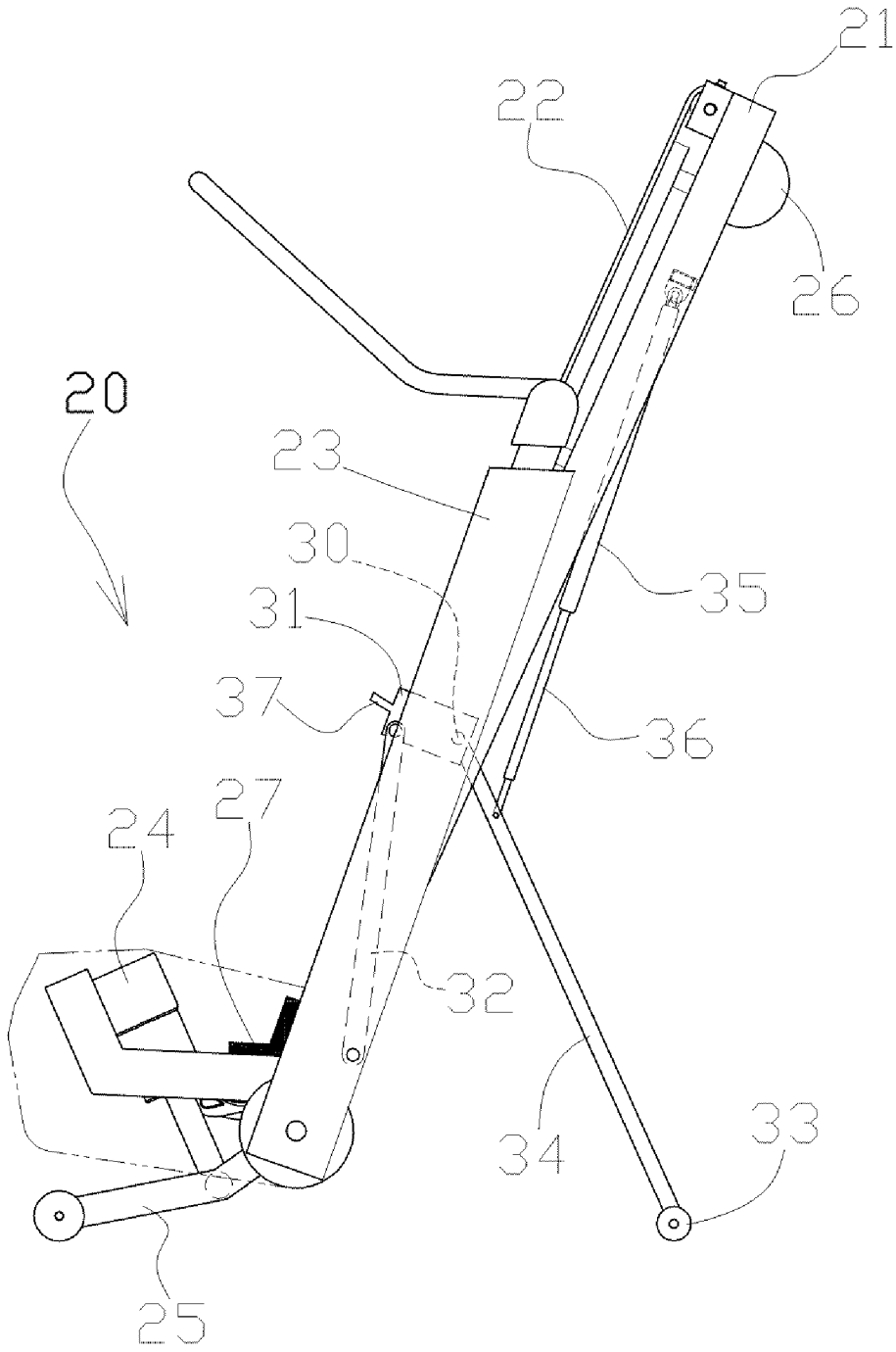
FIG. 4 is a schematic drawing II of the operation of the invention according to FIG. 2.
Figure 5:
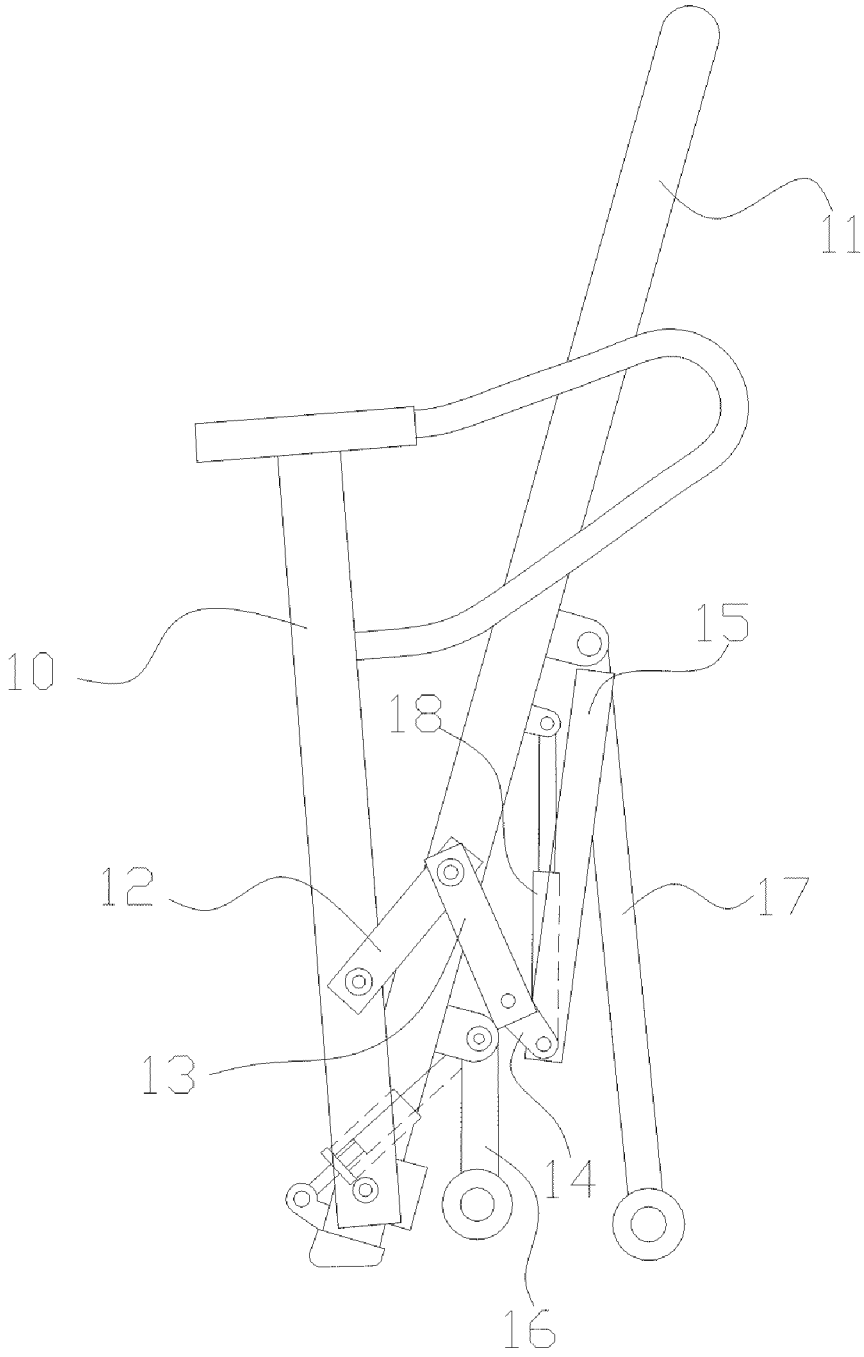
FIG.5 PRIOR ART
FIG. 5 is a schematic drawing of a conventional treadmill with a folding apparatus according to TW 481008 in a fold-up position.

An axle 30 is positioned near the middle portion of the bottom of the base frame 21 for pivotally connecting with a swivel piece 31 at both sides thereof, respectively. A pull rod 32 is pivotally interposed between the swivel piece 31 and the handrail frame 23. Moreover, a rear support frame 34 having ground-touching rollers 33 is pivotally connected to the axle 30 such that the rear support frame 34 is constantly supported by a telescopic support element 35. As shown in FIGS. 2, 3 and 4, the rear support frame 34 is pushed forward by an action portion 36 of the telescopic support element 35 when the base frame 21 is folded upward. Meanwhile, the ground-touching rollers 33 are always in contact with the ground in a supporting position. In this way, the base frame 21 can be brought in a stable folded-up position.

When the base frame 21 is located in an operational position, a blocking plate 27 is positioned in front of the handrail frame 23 to limit the position of the handrail frame 23 in order to avoid the swaying movement between the base frame 21 and the handrail frame 23. In addition, the swivel piece 31 includes a pressure protrusion 37 adjacent to the pull rod 32 for the compression of the pull rod 32. In this way, the pull rod 32, the swivel piece 31, and the rear support frame 34 create a stable supporting state.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An electric treadmill with a folding mechanism, comprising:

a base frame having a first side and a second side;

a continuous moving belt positioned around the base frame;

a handrail frame being mounted to both the first side and the second side of the base frame at a front end of the base frame, the handrail frame having a first and second side;

a front support located below the front end of the base frame;

a plurality of ground-touching elements being fitted below a rear side of the base frame;

a first swivel piece having a rear end directly and pivotable connected to the first side of the base frame;

a second swivel piece having a rear end directly and pivotable connected to the second side of the base frame;

a first pull rod having one end pivotable connected to the first side of the handrail frame and another end directly and pivotable connected to the first swivel piece;

a second pull rod having one end pivotable connected to the second side of the handrail frame and another end directly and pivotable connected to the second swivel piece;

an axle positioned near a middle portion of the bottom of the base frame, a first end of the axle pivotally connecting with the first swivel piece and a second end of the axle pivotally connecting with the second swivel piece;

a rear support frame having ground-touching rollers pivotally connected to the axle; and a telescopic support element pivotally connected to the rear support frame to stabilize and support the rear support frame.

* * * * *